US009893412B2

(12) United States Patent
Parish et al.

(10) Patent No.: US 9,893,412 B2
(45) Date of Patent: Feb. 13, 2018

(54) ANTENNA ATTACHMENT

(71) Applicant: Mueller International, LLC, Atlanta, GA (US)

(72) Inventors: Edward C. Parish, North Reading, MA (US); David Edwin Splitz, Sandwich, MA (US)

(73) Assignee: Mueller International, LLC, Atlanta, GA (US)

( * ) Notice: Subject to any disclaimer, the term of this patent is extended or adjusted under 35 U.S.C. 154(b) by 125 days.

(21) Appl. No.: 14/793,888

(22) Filed: Jul. 8, 2015

(65) Prior Publication Data

US 2016/0013541 A1 Jan. 14, 2016

Related U.S. Application Data

(60) Provisional application No. 62/022,266, filed on Jul. 9, 2014.

(51) Int. Cl.
*H01Q 1/22* (2006.01)
*H01Q 9/26* (2006.01)

(52) U.S. Cl.
CPC ..... *H01Q 1/2233* (2013.01); *H01Q 9/265* (2013.01)

(58) Field of Classification Search
CPC ..... H01Q 1/2233; H01Q 9/265; H01Q 9/16
See application file for complete search history.

(56) References Cited

U.S. PATENT DOCUMENTS

| | | | | |
|---|---|---|---|---|
| 6,262,685 | B1 * | 7/2001 | Welch | H01Q 1/04 340/870.02 |
| 8,299,975 | B2 * | 10/2012 | Savage | H01Q 1/22 343/719 |
| 2006/0284784 | A1 * | 12/2006 | Smith | G01D 4/008 343/872 |
| 2010/0253538 | A1 * | 10/2010 | Smith | G01D 4/002 340/870.02 |

OTHER PUBLICATIONS

Parish, Edward; U.S. Provisional Patent Application entitled: Antenna Attachment, U.S. Appl. No. 62/022,266, filed Jul. 9, 2014; 8 pgs.

* cited by examiner

*Primary Examiner* — Tho G Phan
(74) *Attorney, Agent, or Firm* — Taylor English Duma LLP

(57) ABSTRACT

The present disclosure relates to an antenna attachment. In one example implementation, an antenna attachment includes an attachment body and at least one wire mounted on the attachment body and electric-field coupleable with an antenna.

17 Claims, 3 Drawing Sheets

ANTENNA ATTACHMENT

CROSS REFERENCE TO RELATED APPLICATIONS

This application claims priority to United States Provisional Application No. 62/022,266, filed on Jul. 9, 2014, which is incorporated by reference herein in its entirety.

TECHNICAL FIELD

This disclosure relates to antennas. More specifically, this disclosure relates to antenna attachments for utility meters.

BACKGROUND

Utility meters such as residential water meters are placed underground in a meter box in some situations. Some meter boxes include metal lids and metal bodies. In other situations the meter is placed in a low point, such as the basement or lower level of a building. Utility meters may include wireless communication capability, such as an internal antenna, to send and receive wireless communications with a remote communication device, enabling remote reading of meters, such as in an automatic meter reading or advanced meter infrastructure (AMR/AMI) system or through cellular communication.

SUMMARY

Disclosed is an antenna attachment including an attachment body; and at least one wire mounted on the attachment body and electric-field coupleable with an antenna.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Wireless transmissions from utility meters with wireless capability may be blocked by the lids and/or bodies of meter boxes, especially metal lids, or by a building itself or some other structure. This makes communication between the meter and a remote communication device difficult. Connecting an additional antenna to the meter to increase the range of the wireless communication can also prove difficult because disassembly of components of the meter may be required.

The present disclosure relates to an antenna attachment and associated techniques, including methods, systems, devices, and various apparatus. In one example according to aspects of the present disclosure, an antenna attachment includes an attachment body and at least one electric-field coupling wire attached to the attachment body.

In another example, a system includes an antenna housing having a first pole and a second pole, and an antenna attachment connected to the antenna housing, the antenna attachment having a first wire electric-field coupleable with the first pole of the antenna housing and a second wire electric-field coupleable with the second pole of the antenna housing.

In yet another example, a method of attaching an antenna attachment to an antenna includes connecting the antenna attachment to the antenna, the antenna having a first pole and a second pole and the antenna attachment having a first wire and a second wire. The method further includes positioning the antenna attachment to align the first wire of the antenna attachment with the first pole of the antenna and the second wire of the antenna attachment with the second pole of the antenna.

It would be understood by one of skill in the art that the disclosed antenna attachment and associated techniques are described in but a few embodiments among many. No particular terminology or description should be considered limiting on the disclosure or the scope of any claims issuing therefrom.

Figure 1:
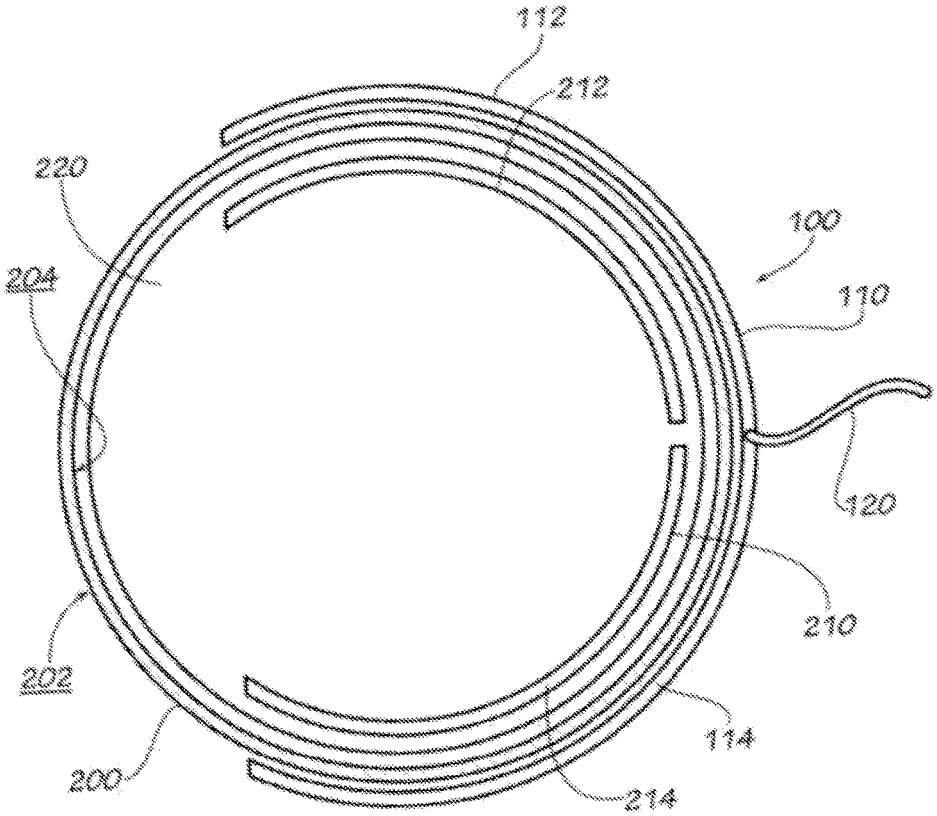
FIG. 1 illustrates a top view of an antenna attachment connected to an antenna housing with the antenna housing shown in cross-section according to examples of the present disclosure.

One embodiment of an antenna attachment 100 is disclosed and described in FIG. 1. In particular, FIG. 1 illustrates a top view of an antenna attachment connected to an antenna housing 200 with the antenna housing 200 shown in cross-section according to examples of the present disclosure. The antenna attachment 100 is attached to an antenna housing 200. The antenna housing 200 is shown in cross-section showing an interior of the antenna housing 200. The antenna housing 200 includes an outer surface 202 and an inner surface 204. The antenna housing 200 is mounted on a meter register 220. An internal dipole antenna 210 is mounted within the antenna housing 200, though other types of antennas, such as a monopole antenna, are mounted in the antenna housing 200 in various embodiments and the disclosure of internal dipole antenna 210 should not be considered limiting.

The internal dipole antenna 210 includes a first pole 212 and a second pole 214. The first pole 212 and the second pole 214 are each a curved printed circuit board ("PCB") in the current embodiment. The first pole 212 and the second pole 214 are attached to the meter register 220. In various embodiments, the first pole 212 and the second pole 214 are wrapped around the meter register 220. In various embodiments, the register 220 includes a liquid crystal display ("LCD") on a PCB (not shown). The first pole 212 and the second pole 214 are each connected to the LCD by soldering the PCBs together in the current embodiment, with the PCB of the first pole 212 soldered to the LCD PCB and the PCB of the second pole 214 to the LCD PCB.

The interior of the antenna housing 200 is filled with resin (not shown) in various embodiments to hold first pole 212, the second pole 214, and the meter register 220 in place and protect the first pole 212, the second pole 214, and the meter register 220 from exposure to moisture and air. In various embodiments, resin is not present. The first pole 212 and the second pole 214 are spaced a small distance from the inner surface 204 of the antenna housing 200, but in various embodiments the first pole 212 and the second pole 214 are placed against the inner surface 204.

The antenna attachment 100 is a clip in the current embodiment having a clip body 110. The antenna attachment 100 also includes a coaxial cable 120 extending from the clip body 110 to an external antenna (not shown). The clip body 110 is plastic and has a C-shaped cross-section in the current embodiment, though the clip body 110 is formed from various materials and is formed in various shapes in various embodiments. The clip body 110 includes a first half 112 and a second half 114. The coaxial cable 120 extends into the clip body 110 and connects to a first wire (not shown) and a second wire (not shown) embedded in the clip body 110. The first wire is embedded in the first half 112 of the clip body 110 and the second wire is embedded in the second half 114 of the clip body 110 in the current embodiment.

The antenna attachment 100 is attached to the antenna housing 200 in the current embodiment by placing the clip body 110 around the antenna housing 200. The clip body 110 is snapped around the antenna housing 200 and is held in place by the C-shape of the clip body 110 matching the outer surface 202 of the antenna housing 200. The clip body 110 is shown spaced slightly apart from the antenna housing 200 in FIG. 1 to distinguish between the clip body 110 and the antenna housing 200 but would be in contact with the outer surface 202 of the antenna housing 200 to firmly connect the clip body 110 to the antenna housing 200.

The clip body 110 is positioned around the antenna housing 200 such that the first half 112 of the clip body 110 is positioned proximate the first pole 212 of the internal dipole antenna 210 and the second half 114 of the clip body 110 is positioned proximate the second pole 214 of the internal dipole antenna 210. This position places the first wire adjacent to the first pole 212 of the internal dipole antenna 210 and places the second wire adjacent to the second pole 214 of the internal dipole antenna 210.

When the first wire is positioned adjacent to the first pole 212 and the second wire is positioned adjacent to the second pole 214, the first wire and the second wire, and thereby the external antenna, become electric-field coupled by inductive coupling to the internal dipole antenna 210. The external antenna thereby broadcasts the signal from the internal dipole antenna 210, extending the range of the signal from the internal dipole antenna 210. The external antenna can thereafter be positioned into an optimal position, such as outside of a meter pit or into a higher position relative to the meter, to communicate with a remote communication device (not shown). In various embodiments, the first wire and the second wire may be electric-field coupled by capacitive coupling to the antenna 210. In various embodiments, the first wire and the second wire may be replaced by plates embedded in the clip body 110.

In the current embodiment, the external antenna does not require an external power amplifier to boost the signal from the first wire and second wire to the external antenna and the strength of the signal from the internal dipole antenna 210 is sufficient. In various embodiments, such as where the coaxial cable 120 must extend a long distance to place the external antenna in an ideal location, an external power amplifier may be supplied.

In various embodiments, the antenna attachment 100 takes any number of arrangements, including but not limited to a cap or sheath to place over the antenna housing 200, a tightenable band to wrap around antenna housing 200, or any other arrangement that that electric-field couples the external antenna to the internal dipole antenna 210. The disclosure of a clip body 110 should not be considered limiting. The antenna attachment 100 may be attached to the antenna housing 200 by any number of attachment mechanisms in various embodiments, such as threading, fasteners such as nuts and bolts, gluing, welding, snap fits, or various fits such as a cap or sheath sized to fit over the antenna housing 200 or a band adjustable to tighten around the antenna housing 200.

Figure 2:
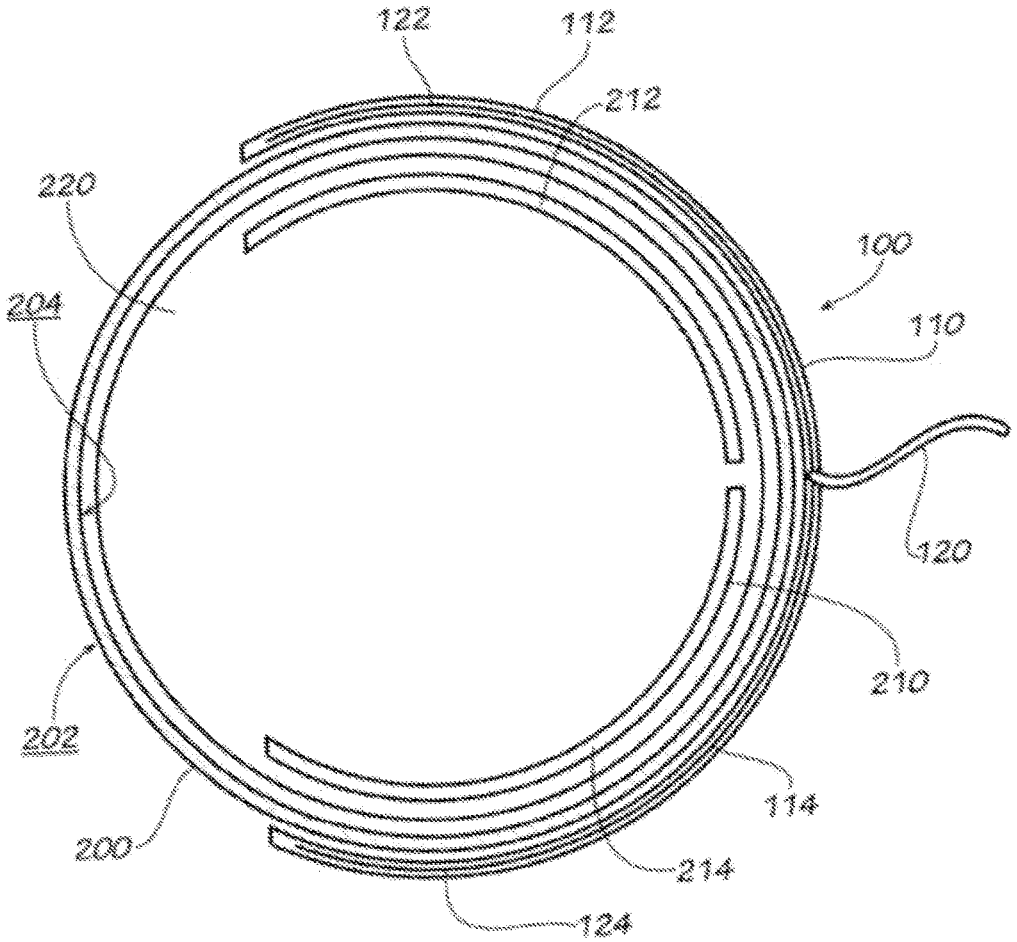
FIG. 2 illustrates a top view of an antenna attachment connected to an antenna housing with the antenna housing shown in cross-section according to examples of the present disclosure.

Another embodiment of an antenna attachment 100 is disclosed and described in FIG. 2. In particular, FIG. 2 illustrates a top view of an antenna attachment 100 connected to the antenna housing 200 with the antenna housing 200 shown in cross-section according to examples of the present disclosure. As in FIG. 1, in the example of FIG. 2, the antenna attachment 100 is connected to the antenna housing 200. The antenna housing 200 includes an outer surface 202 and an inner surface 204. In examples, the antenna housing 200 is mounted on a meter register 220. An internal dipole antenna 210 is mounted within the antenna housing 200, though other types of antennas, such as a monopole antenna, are mounted in the antenna housing 200 in various examples and the disclosure of internal dipole antenna 210 should not be considered limiting.

As in FIG. 1, the internal dipole antenna 210 of the antenna housing 200 of FIG. 2 includes a first pole 212 and a second pole 214. The first pole 212 and the second pole 214 are electric-field coupleable with the antenna attachment 110. In particular, the antenna attachment 100 includes a first wire 122 and a second wire 124. The first wire 122 is electric-field coupleable with the first pole 212 of the antenna housing 200 and the second wire 124 is electric-field coupleable with the second pole 124 of the antenna housing 200. The first wire 122 and the second wire 124 are connected to the coaxial cable 120. For example, the coaxial cable 120 extends into the clip body 110 and connects to the first wire 122 and to the second wire 124 embedded in the clip body 110 of the antenna attachment 110. The first wire 122 is embedded in the first half 112 of the clip body 110 and the second wire 124 is embedded in the second half 114 of the clip body 110 in the current embodiment. In examples, the coaxial cable 120 connects to an external antenna. In this way, the first wire 122 and the second wire 124 are connected to the external antenna via the coaxial cable 120.

The clip body 110 is positioned around the antenna housing 200 such that the first half 112 of the clip body 110 is positioned proximate the first pole 212 of the internal dipole antenna 210 and the second half 114 of the clip body 110 is positioned proximate the second pole 214 of the internal dipole antenna 210. This position places the first wire 122 adjacent to the first pole 212 of the internal dipole antenna 210 and places the second wire 124 adjacent to the second pole 214 of the internal dipole antenna 210.

When the first wire 122 is positioned adjacent to the first pole 212 and the second wire 124 is positioned adjacent to the second pole 214, the first wire 122 and the second wire 124, and thereby the external antenna, become electric-field coupled by inductive coupling to the internal dipole antenna 210. This configuration results in a dipole antenna (the first pole 212 and the second pole 214) being coupled to another dipole antenna (the first wire 122 and the second wire 124). The external antenna thereby broadcasts the signal from the internal dipole antenna 210, extending the range of the signal from the internal dipole antenna 210. The external antenna can thereafter be positioned into an optimal position, such as outside of a meter pit or into a higher position relative to the meter, to communicate with a remote communication device (not shown). In various embodiments, the first wire 122 and the second wire 124 may be electric-field coupled by capacitive coupling to the antenna 210. In various embodiments, the first wire 122 and the second wire 124 may be replaced by plates embedded in the clip body 110.

Figure 3:
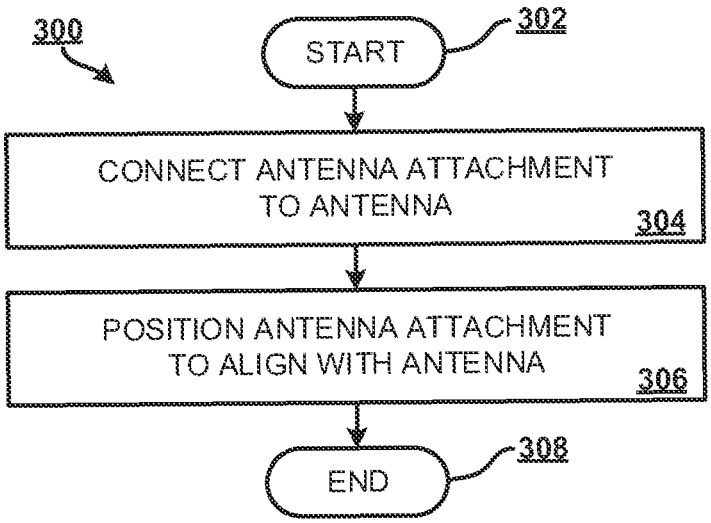
FIG. 3 illustrates a method of connecting and positioning an antenna attachment on an antenna according to examples of the present disclosure.

FIG. 3 illustrates a method 300 of connecting and positioning an antenna attachment on an antenna according to examples of the present disclosure. At block 302, the method 300 begins and continues to block 304. At block 304, the method 300 includes connecting an antenna attachment to an antenna. In examples, the antenna includes a first pole and a second pole and the antenna attachment includes a first wire and a second wire. The antenna attachment may define a shape matching an outer surface of a housing that houses the antenna, and the shape may be a C-shape. The method 300 continues to block 306.

At block 306, the method 300 includes positioning the antenna attachment to align with the antenna. For example, positioning the antenna to align with the antenna may include positioning the antenna attachment to align the first wire of the antenna attachment with the first pole of the antenna and the second wire of the antenna attachment with the second pole. In examples, the positioning causes the first wire and the second wire of the antenna attachment to be electric-field coupled to the respective first pole and the second pole of the antenna. The method 300 continues to block 308 and terminates.

Additional processes also may be included. For example, the method 300 may include mounting the antenna housing on a meter register. The method 300 may also include connecting an external antenna to the antenna attachment. It should be understood that the processes depicted in FIG. 3 represent illustrations, and that other processes may be added or existing processes may be removed, modified, or rearranged without departing from the scope and spirit of the present disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An antenna attachment comprising:

an attachment body having an arcuate shape; and at least one wire mounted on the attachment body and electric-field coupleable with a pole of an antenna, wherein the at least one wire and the pole are concentric when the attachment body is attached to the antenna.

2. The antenna attachment of claim 1, wherein the attachment body defines a shape matching an outer surface of a housing to house the antenna.

3. The antenna attachment of claim 2, wherein the attachment body is a C-shaped clip.

4. The antenna attachment of claim 2, wherein the housing, the attachment body, and the antenna are concentric when aligned.

5. The antenna attachment of claim 1, wherein the at least one wire includes a first wire and a second wire, wherein the antenna is a dipole antenna having a first pole and a second pole, and wherein the first wire is electric-field coupleable to the first pole of the antenna and the second wire is electric-field coupleable to the second pole of the antenna.

6. The antenna attachment of claim 5, wherein the attachment body includes a first half and a second half, wherein the first wire is mounted on the first half of the attachment body and the second wire is mounted on the second half of the attachment body.

7. The antenna attachment of claim 5, wherein the first wire is inductively coupleable to the first pole of the antenna and the second wire is inductively coupleable to the second pole of the antenna.

8. The antenna attachment of claim 5, wherein the first wire is capacitively coupleable to the first pole of the antenna and the second wire is capacitively coupleable to the second pole of the antenna.

9. The antenna attachment of claim 5, wherein the first wire is positioned proximate to the first pole of the antenna and the second wire is positioned proximate to the second pole of the antenna.

10. The antenna attachment of claim 1, further comprising an external antenna connected to the at least one wire.

11. The antenna attachment of claim 10, wherein the external antenna is connected to the at least one wire via a coaxial cable.

12. The antenna attachment of claim 1, wherein the antenna housing is mounted on a meter register.

13. An antenna attachment apparatus comprising:

a clip body configured to be attached externally to an antenna housing, the clip body comprising a first half and a second half, the antenna housing enclosing a dipole antenna;

a first wire embedded in the first half of the clip body;

a second wire embedded in the second half of the clip body;

an external dipole antenna; and a cable connecting the first wire and the second wire to the external dipole antenna, wherein the first wire aligns with a first pole of the external dipole antenna and the second wire aligns with a second pole of the external dipole antenna when the clip body is attached to the antenna housing.

14. The antenna attachment apparatus of claim 13, wherein the clip body comprises an arcuate shape.

15. The antenna attachment apparatus of claim 14, wherein the antenna housing and the clip body are concentric.

16. The antenna attachment apparatus of claim 13, wherein the first wire and the first pole of the external dipole antenna are concentric and the second wire and the second pole of the external dipole antenna are concentric when the clip body is attached to the antenna housing.

17. The antenna attachment apparatus of claim 13, wherein the antenna housing is mounted on a meter register.

* * * * *